US012685371B2

(12) United States Patent
Ng

(10) Patent No.: US 12,685,371 B2
(45) Date of Patent: Jul. 21, 2026

(54) LOOM WITH ROTATIONALLY INCREMENTABLE PINS

(71) Applicant: Choon's Design LLC, Farmington Hills, MI (US)

(72) Inventor: Cheong Choon Ng, Novi, MI (US)

(73) Assignee: CHOON'S DESIGN LLC, Farmington Hills, MI (US)

( * ) Notice: Subject to any disclaimer, the term of this patent is extended or adjusted under 35 U.S.C. 154(b) by 0 days.

(21) Appl. No.: 18/908,978

(22) Filed: Oct. 8, 2024

(65) Prior Publication Data

US 2026/0096637 A1 Apr. 9, 2026

(51) Int. Cl.

| | |
|---|---|
| ***A44C 27/00*** | (2006.01) |
| ***A44C 5/00*** | (2006.01) |
| ***B65H 69/04*** | (2006.01) |

(52) U.S. Cl.

CPC ..... *A44C 27/00* (2013.01); *A44C 5/0069* (2013.01); *B65H 69/04* (2013.01)

(58) Field of Classification Search

CPC ..... A44C 27/00; A44C 5/0069; B65H 69/04
See application file for complete search history.

(56) References Cited

U.S. PATENT DOCUMENTS

| | | | |
|---|---|---|---|
| 38,192 | A | 4/1863 | Wilcox |
| 86,119 | A | 1/1869 | Allport |
| 222,937 | A | 12/1879 | Newcomb |
| 246,648 | A | 9/1881 | Wilcox |
| 254,258 | A | 2/1882 | Barbour |
| 254,288 | A | 2/1882 | Dimmick |
| 266,958 | A | 10/1882 | Gordon |
| 289,578 | A | 12/1883 | Stewart |
| 426,087 | A | 4/1890 | Wolkow |
| 763,303 | A | 6/1904 | Mayers |
| 782,657 | A | 2/1905 | Hubert |
| 843,495 | A | 2/1907 | Sander |
| 904,747 | A | 11/1908 | Anderson |
| 968,199 | A | 8/1910 | Schwartz |
| 1,020,963 | A | 3/1912 | Cake |
| 1,073,226 | A | 9/1913 | Freeman |
| 1,176,482 | A | 3/1916 | Orme |
| D51,186 | S | 8/1917 | Pearson |
| 1,279,411 | A | 9/1918 | Neuman |

(Continued)

FOREIGN PATENT DOCUMENTS

| | | |
|---|---|---|
| CH | 201594 | 12/1938 |
| CN | 101736519 A | 6/2010 |

(Continued)

OTHER PUBLICATIONS

Translation JP 2003171854.*

(Continued)

*Primary Examiner* — Shaun R Hurley

(74) *Attorney, Agent, or Firm* — Carlson, Gaskey & Olds, P.C.

(57) ABSTRACT

A kit for creating Brunnian link items such as bracelets, necklaces and other wearable or decorative items is disclosed and includes a loom, a hook, and a plurality of clips and a plurality of elastic bands. The loom includes a base supporting a plurality of upward extending pins. Each of the pins includes a flange for holding an elastic band in a desired orientation.

33 Claims, 11 Drawing Sheets

(56) References Cited

U.S. PATENT DOCUMENTS 1,318,465 A 10/1919 Seifarth
1,318,604 A 10/1919 Schneider
1,366,212 A 1/1921 Pollard
1,375,119 A 4/1921 Stephen
1,405,744 A 2/1922 Sampliner
1,424,458 A 8/1922 Fleisher
1,500,383 A 7/1924 Gourie
1,599,040 A 9/1926 Clisby
1,647,060 A 10/1927 Speidel
1,694,849 A 12/1928 Fujii
1,705,860 A 3/1929 Hagihara
1,718,140 A 6/1929 Hagihara
1,776,561 A 9/1930 Croix
1,878,861 A 9/1932 Krasnow
1,966,247 A 7/1934 Janssen
1,994,659 A 3/1935 Mascarenhas
2,000,504 A 5/1935 Adrian
2,072,668 A 3/1937 Eltgroth
2,108,424 A 2/1938 Bakely
2,134,066 A 10/1938 Van Ness
2,186,692 A 1/1940 Boyer et al.
2,237,733 A 4/1941 Grimm et al.
2,270,619 A 1/1942 Bowyer
2,274,572 A 2/1942 Yates
D135,390 S 3/1943 Lains
2,318,018 A 5/1943 Semonsen
2,360,416 A 10/1944 Gray
D144,079 S 3/1946 Smith
D146,830 S 5/1947 Kimmelstiel
2,433,307 A 12/1947 Thomas
2,450,067 A 9/1948 Wolff
2,457,064 A 12/1948 Parisi
2,540,383 A 2/1951 Tillert et al.
2,545,409 A 3/1951 McCall
2,600,091 A 6/1952 Becker
D167,727 S 9/1952 Teare
2,625,345 A 1/1953 De Palma
2,658,364 A 11/1953 Carlson
2,666,249 A 1/1954 Ruiz et al.
2,687,630 A 8/1954 Carlson
2,703,482 A 3/1955 Auran
2,707,052 A 4/1955 Brown
2,726,434 A 12/1955 Knoblock et al.
2,727,663 A 12/1955 Gribben
2,879,095 A 3/1959 Altenweger
D185,930 S 8/1959 Park
2,984,488 A 5/1961 Kirchner
3,054,214 A 9/1962 Smith et al.
3,069,739 A 12/1962 Jorgenson et al.
3,112,491 A 12/1963 Cleveland
D204,442 S 4/1966 Brawley, Jr.
3,276,181 A 10/1966 Gilbert
3,377,674 A 4/1968 Brassaw et al.
3,438,098 A 4/1969 Grabner
3,438,223 A 4/1969 Linstead
3,476,423 A 11/1969 Kentfield
3,476,426 A 11/1969 Lewin
3,506,215 A 4/1970 Krikorian
3,572,679 A 3/1971 Strauff
3,636,987 A 1/1972 Forby
3,648,484 A 3/1972 Gordon
3,665,971 A 5/1972 Ileks
3,672,679 A 6/1972 Burns
3,678,709 A 7/1972 Nowicki et al.
3,688,357 A 9/1972 Nielsen et al.
3,693,976 A 9/1972 Flack
3,728,762 A 4/1973 Hogg
3,748,706 A 7/1973 Doyel
3,758,923 A 9/1973 Maude
3,800,372 A 4/1974 Daoust
3,805,345 A 4/1974 Antos
3,853,021 A 12/1974 Hayes
3,905,133 A 9/1975 Charman
D238,812 S 2/1976 Fioretti
4,018,543 A 4/1977 Carson et al.
4,023,245 A 5/1977 Zaltzman
4,032,179 A 6/1977 Goss
4,037,513 A 7/1977 Hobson
D245,748 S 9/1977 Ostroll
4,066,271 A 1/1978 Lohr
D248,347 S 7/1978 McCollum
4,114,892 A 9/1978 Csoka
4,131,138 A 12/1978 Boisvert
4,179,129 A 12/1979 Loomis
D257,257 S 10/1980 McArthur
4,248,063 A 2/1981 Wang
4,416,040 A 11/1983 Towsley
D279,938 S 8/1985 Okada
4,569,108 A 2/1986 Schwab
4,629,100 A 12/1986 Owens
4,667,965 A 5/1987 Helms, Jr.
4,680,021 A 7/1987 Maxim
4,729,229 A 3/1988 Whicker
4,790,575 A 12/1988 Tate
4,844,473 A 7/1989 Landsberg
D310,672 S 9/1990 Harvey et al.
D330,668 S 11/1992 Nagamatsu
5,163,946 A 11/1992 Li
5,231,742 A 8/1993 Macbain
5,295,280 A 3/1994 Hudson et al.
5,328,374 A 7/1994 Stevens
5,331,725 A 7/1994 Chou
5,377,595 A 1/1995 Liu
D358,402 S 5/1995 Scholl
5,426,788 A 6/1995 Meltzer
5,437,459 A 8/1995 Kirby
5,459,905 A 10/1995 Voyre
5,577,299 A 11/1996 Thompson et al.
5,639,090 A 6/1997 Stevens
5,687,775 A 11/1997 Thompson et al.
D389,050 S 1/1998 Li
5,713,094 A 2/1998 Markey et al.
D396,159 S 7/1998 Anderson et al.
D406,749 S 3/1999 Selk
5,888,392 A 3/1999 Frizell
5,916,283 A 6/1999 Steinbach
5,927,764 A 7/1999 Harriman
D425,784 S 5/2000 Beugelsdyk et al.
6,065,968 A 5/2000 Corliss
D426,425 S 6/2000 Hermanski
6,122,859 A 9/2000 Lazar
6,129,551 A 10/2000 Martin
6,131,778 A 10/2000 Etzion
6,146,144 A 11/2000 Fowler et al.
6,149,436 A 11/2000 Dunn
6,171,317 B1 1/2001 Jackson et al.
6,209,930 B1 4/2001 Johnston et al.
6,213,918 B1 * 4/2001 Rogers, Jr. ..... A63B 23/16 601/40
6,389,652 B1 5/2002 Williams
6,550,177 B1 4/2003 Epple, Jr.
D478,738 S 8/2003 Workman
6,786,032 B2 9/2004 Chia et al.
6,880,364 B1 4/2005 Vidolin et al.
6,902,212 B1 6/2005 Mize
6,923,026 B1 8/2005 Clarke
7,040,120 B2 5/2006 Hunter
D522,352 S 6/2006 Van Straaten
7,240,797 B1 7/2007 Grossman
7,264,282 B2 9/2007 Lambertz et al.
D552,463 S 10/2007 French et al.
D562,358 S 2/2008 Landmesser
D563,997 S 3/2008 Gustin
D570,882 S 6/2008 Lee
D570,923 S 6/2008 Vazquez Gastellu
D578,383 S 10/2008 Adams
7,506,524 B2 3/2009 Gustin
D592,537 S 5/2009 Darnell
7,578,146 B2 8/2009 Gustin
7,617,947 B2 11/2009 Schafer
D608,189 S 1/2010 Jackson et al.
7,666,196 B1 2/2010 Miles
7,677,677 B1 3/2010 Roberts
7,891,506 B2 2/2011 Kornowski

(56) References Cited

U.S. PATENT DOCUMENTS

| | | | | |
|---|---|---|---|---|
| 7,909,609 | B2 | 3/2011 | Molin | |
| D635,594 | S | 4/2011 | Novak | |
| D639,683 | S | 6/2011 | Essel | |
| 8,104,486 | B2 | 1/2012 | Imai et al. | |
| 8,171,639 | B2 | 5/2012 | Jaykins et al. | |
| 8,234,850 | B1 | 8/2012 | Wright | |
| 8,316,894 | B2 * | 11/2012 | Schaub | D04B 3/00 139/34 |
| 8,402,794 | B2 | 3/2013 | Sasur | |
| 8,418,434 | B1 | 4/2013 | Carruth et al. | |
| D686,253 | S | 7/2013 | Wijerama et al. | |
| 8,485,565 | B2 | 7/2013 | Ng | |
| 8,510,916 | B2 | 8/2013 | Kinvi | |
| D690,191 | S | 9/2013 | Takakuwa et al. | |
| D696,576 | S | 12/2013 | Ng | |
| 8,596,096 | B1 | 12/2013 | Russell et al. | |
| 8,622,441 | B1 | 1/2014 | Ng | |
| 8,684,420 | B2 | 4/2014 | Ng | |
| D707,732 | S | 6/2014 | Crorey | |
| 8,746,753 | B2 * | 6/2014 | Crorey | D04G 5/00 289/13 |
| D711,931 | S | 8/2014 | Daftari | |
| 8,899,631 | B2 | 12/2014 | Ng | |
| D721,744 | S | 1/2015 | Daftari | |
| 8,931,811 | B1 | 1/2015 | Ng | |
| 8,936,283 | B2 | 1/2015 | Ng | |
| 8,973,955 | B2 | 3/2015 | Ng | |
| D732,582 | S | 6/2015 | Verona | |
| D737,340 | S | 8/2015 | Shirai et al. | |
| D745,066 | S | 12/2015 | Ng | |
| D748,158 | S | 1/2016 | Ng | |
| D748,159 | S | 1/2016 | Ng | |
| 9,234,306 | B1 | 1/2016 | Chang | |
| D754,216 | S | 4/2016 | Ng | |
| D773,174 | S | 12/2016 | Okuma | |
| 9,750,315 | B2 | 9/2017 | Ng | |
| 9,848,679 | B2 * | 12/2017 | Ng | A44C 5/0069 |
| 9,903,055 | B2 * | 2/2018 | Todokoro | D04B 5/00 |
| D892,178 | S | 8/2020 | Tam et al. | |
| 10,791,807 | B2 * | 10/2020 | Ng | A44C 27/00 |
| 11,019,891 | B2 | 6/2021 | Ng | |
| 2004/0079109 | A1 | 4/2004 | Crova | |
| 2007/0114340 | A1 | 5/2007 | Adams | |
| 2007/0199965 | A1 | 8/2007 | Gouldson | |
| 2008/0156043 | A1 | 7/2008 | Gustin | |
| 2008/0223083 | A1 | 9/2008 | Gustin | |
| 2009/0215013 | A1 | 8/2009 | Molin | |
| 2009/0272148 | A1 | 11/2009 | Jaykins | |
| 2010/0019495 | A1 | 1/2010 | Oliveto | |
| 2010/0163069 | A1 | 7/2010 | Imai et al. | |
| 2011/0067558 | A1 | 3/2011 | Saindon | |
| 2011/0152946 | A1 | 6/2011 | Frigg et al. | |
| 2011/0204554 | A1 | 8/2011 | Younger | |
| 2011/0259465 | A1 * | 10/2011 | Schaub | D04B 3/00 206/574 |
| 2012/0047960 | A1 | 3/2012 | Sasur | |
| 2012/0112457 | A1 * | 5/2012 | Ng | D04D 7/04 289/1.5 |
| 2012/0150203 | A1 | 6/2012 | Brady et al. | |
| 2012/0186217 | A1 | 7/2012 | Wright | |
| 2012/0297749 | A1 | 11/2012 | Dhongade | |
| 2013/0020802 | A1 | 1/2013 | Ng | |
| 2013/0300114 | A1 | 11/2013 | Ng | |
| 2013/0307267 | A1 | 11/2013 | Ng | |
| 2014/0239635 | A1 | 8/2014 | Ng | |
| 2014/0373966 | A1 | 12/2014 | Nedry et al. | |
| 2015/0042091 | A1 | 2/2015 | Tommer et al. | |
| 2015/0296937 | A1 * | 10/2015 | Ng | D04D 11/00 289/17 |
| 2016/0032500 | A1 | 2/2016 | Novak et al. | |

FOREIGN PATENT DOCUMENTS

| | | | | |
|---|---|---|---|---|
| DE | 521894 | | | 3/1931 |
| GB | 2147918 | | | 5/1985 |
| JP | S03-001676 | Y | | 2/1928 |
| JP | S61111987 | U | | 7/1986 |
| JP | H0325590 | U | | 3/1991 |
| JP | H09291447 | | | 11/1997 |
| JP | 2003171854 | A | * | 6/2003 |
| JP | 2003-520083 | | | 7/2003 |
| JP | 2004-520910 | | | 7/2004 |
| JP | 3108472 | U | | 4/2005 |
| JP | 3120700 | U | | 4/2006 |
| JP | 4214168 | B1 | | 1/2009 |
| JP | D1393632 | | | 8/2010 |
| JP | 2010261130 | A | | 11/2010 |
| JP | 2011117103 | A | | 6/2011 |
| JP | 2012162837 | A | | 8/2012 |
| JP | D1501836 | | | 7/2014 |
| JP | D1501837 | | | 7/2014 |
| KR | 10-2001-0012609 | | | 2/2001 |
| KR | 10-2006-0042108 | | | 5/2006 |
| KR | 300503642 | | | 5/2008 |
| WO | 2012060906 | A1 | | 5/2012 |
| WO | 2014190255 | A1 | | 11/2014 |

OTHER PUBLICATIONS

Petition for Inter Partes Review of U.S. Pat. No. 8,485,565 and Exhibits, filed in the United States Patent and Trademark Office on May 1, 2015, Case No. IPR2015-01139.

Petition for Inter Partes Review of U.S. Pat. No. 8,684,420 and Exhibits, filed in the United States Patent and Trademark Office on May 4, 2015, Case No. IPR2015-01143.

Renz, Katie, Provo Craft—Knifty Knitter, CraftCritique.com, http://www.craftcritique.com/2008/09/19/provo-craft-knifty-knitter/, Sep. 19, 2008.

Phelps, Isela G., Loom Knitting Basics: Knitting in the Round, www.dalooms.com, 2001.

Finger Weave Jump Rope, http://www.makingfriends.com/jump_rope.htm, Date unknown.

How to Make a Homemade Geoboard, http://www.feelslikehomeblog.com/2010/02/how-to-make-a-geoboard/, Feb. 21, 2010.

Bipes, Anne, Loom Knitting Getting Started on the Round Loom, www.loomknitting.com, 2005.

International Preliminary Report on Patentability for International Application No. PCT/US2014/054475 mailed Mar. 24, 2016.

Petition for Inter Partes Review of U.S. Pat. No. 8,684,420 and Exhibits, filed in the United States Patent and Trademark Office on Sep. 4, 2015, Case No. IPR2015-01883.

Takacs, Sararah (SoCraftastic), "Rainbow Loom—Single Bracelet—How to—No Loom," Published Oct. 15, 2010 https://www.youtube.com/watch?v=rwgpfOkuZDY.

Order Granting Request for Ex Parte Reexamination for U.S. Appl. No. 90/019,235 mailed Sep. 13, 2023.

U.S. Appl. No. 18/398,609, filed Dec. 28, 2023.

U.S. Appl. No. 63/541,378, filed Sep. 29, 2023.

Official_rainbowloom, "Make custom friendship bracelets with glow-in-the-dark Loomoji Charms!", (posted Dec. 5, 2019), Instagram.com, URL :<https://www.instagram.com/p/B5su4ioh345/> (Year: 2019).

Rainbow Loom, Rainbow Loom Crafting Kit includes Loom, Metal Hook, Mini Rainbow Loom, 600 Rubber Bands + 24 Clips, (First available Aug. 1, 2018), Amazon.com, URL :<https://www.amazon.com/Rainbow-Loom-Crafting-Metal-Rubber/dp/B00DMC6KAC> (Year: 2018).

How to Make Rubber Band Bracelets Using Twistz Bandz—Instruction #1; http://www.youtube.com/watch?v=6nInnVEjrLU; Mar. 28, 2011.

Various rubber band crafts and bracelets using Rainbow Loom®; http://www.youtube.com/watch?v=oM6sOkZFz5o; Mar. 30, 2011.

How to make "Diamond" pattern rubber band bracelet using the Rainbow Loom® Kit; http://www.youtube.com/watch?v=dZa8dpZasKA; Jun. 8, 2011.

(56) References Cited

OTHER PUBLICATIONS

Rainbow Loom®) Twistz Bandz product—with bloopers; http://www.youtube.com/watch?v=DbzS5u8ib_0; Jul. 6, 2011.
Defendants' Preliminary Non-Binding Invalidity Contentions, *Choon's Design LLC* v. *Zenacon, LLC* et al., United States District Court for the Eastern District of Michigan, Case No. 2:13-cv-13568-PJD-RSW, Mar. 7, 2014.
Decision to Institute of Inter Partes Review of U.S. Pat. No. 8,485,565 dated May 20, 2014, Case IPR2014-00218, from the United States Patent and Trademark Office.
Petitioner's Request for Rehearing Under 37 CFR §42.71(d) filed on Jun. 3, 2014, Case IPR2014-00218, from the United States Patent and Trademark Office.
U.S. Appl. No. 13/938,717, filed Jul. 10, 2013, entitled "Brunnian Link Making Device and Kit".
U.S. Appl. No. 14/329,099, filed Jul. 11, 2014, entitled "Brunnian Link Making Device and Kit".
U.S. Appl. No. 13/626,057, filed Sep. 25, 2012, entitled "Brunnian Link Making Device and Kit".
U.S. Appl. No. 14/331,456, filed Jul. 15, 2014, entitled "Hand Held Link Making Device and Kit".
U.S. Appl. No. 14/270,635, filed May 6, 2014, entitled "Device for Forming Brunnian Links".
Design U.S. Appl. No. 29/468,891, filed Oct. 24, 2013, entitled "Brunnian Link Forming Loom".
Design U.S. Appl. No. 29/468,549, filed Oct. 1, 2013, entitled "Brunnian Link Forming Loom".
U.S. Appl. No. 14/226,096, filed Mar. 26, 2014, entitled "Monster Tail Loom for Forming Brunnian Links".
International Search Report and Written Opinion for International Application No. PCT/US14/54492 mailed Jan. 5, 2015.
European Search Report for EP Application No. 14184490.2 dated Dec. 23, 2014.
International Search Report & Written Opinion for International Application No. PCT/US2011/041553 mailed on Feb. 23, 2012.
International Preliminary Report on Patentability for International Application No. PCT/US2011/041553 mailed on May 16, 2013.
United Kingdom Combined Search and Examination Report for Application No. GB1416090.1 dated Oct. 16, 2014.
United Kingdom Combined Search and Examination Report for Application No. GB1416091.5 dated Oct. 16, 2014.
International Search Report and Written Opinion for International Application No. PCT/US14/46106 mailed Oct. 18, 2014.
International Search Report and Written Opinion for International Application No. PCT/US14/54475 mailed Oct. 27, 2014.
How to make a fishtail rainbow loom bracelet; http://www.youtube.com/watch?v=ukv83Cvq3jk; Jul. 13, 2013.
European Search Report for EP Application No. 13840473.6 dated Jul. 3, 2014.
Petition for Post-Grant Review of U.S. Pat. No. 8,684,420 and Exhibits, filed in the United States Patent and Trademark Office on Aug. 5, 2014, Case No. PGR2014-00008.
Petition for Inter Partes Review of U.S. Pat. No. 8,485,565 and Exhibits, filed in the United States Patent and Trademark Office on Aug. 20, 2014, Case No. IPR2014-01353.
Takacas, Sarah (SarahLynnTea), How to Make Rubber Band Bracelets'; Published Apr. 15, 2009 http://www.youtube.com/watch?v=e0k762PJ-D8.
Introduction video—Rainbow Loom (the next generation Twistz Bandz kit). Published Sep. 24, 2012. http://www.youtube.com/watch?v=FUwf3CheGuw.
Lesson 21: "Sweet Heart" Rainbow Loom Bracelet by Choon; Published Jan. 21, 2013 http://www.youtube.com/watch?v=7l8MbYceEC0.
Rainbow Loom from Choon's Design, LLC; Published Jul. 24, 2013 http://www.youtube.com/watch?v=vhiVxnbE0CE.
How to make a rainbow loom starburst bracelet; Published Aug. 1, 2013 http://www.youtube.com/watch?v=RI7AkI5dJzo.
How to: Make the Rainbow Loom Single Band Bracelet; Published Aug. 12, 2013 http://www.youtube.com/watch?v=Wd3UdqPmKbA.
European Search Report for EP Application No. 14177709.4 dated Nov. 18, 2014.
European Search Report for EP Application No. 14184498.5 dated Jan. 26, 2015.
International Preliminary Report on Patentability for International Application No. PCT/US2013/060890 mailed Apr. 9, 2015.
Petition for Inter Partes Review of U.S. Pat. No. 8,622,441 and Exhibits, filed in the United States Patent and Trademark Office on Mar. 3, 2015, Case No. IPR2015-00840.
Norris, Kathy, I Can't Believe I'm Loom Knitting!, www.leisurearts.com, 2010.
Phelps, Isela, Loom Knitting Primer: A Beginner's Guide to Knitting on a Loom with Over 30 Fun Projects, 2007.
Lijovich, Basic Instructions for Using a Double Lucet, Jan. 2002, revised Jun. 2002.
The Horde of Vigdis, Aug. 5, 2011.
International Search Report and Written Opinion for International Application No. PCT/US2013/060890 mailed Jan. 2, 2014.
International Preliminary Report on Patentability for International Application No. PCT/US2014/054492 mailed Mar. 24, 2016.
International Search Report and Written Opinion for International Application No. PCT/US2015/026280 mailed Jul. 14, 2015.
Helmet Strap Quick Release Clip, catalog added date Nov. 10, 2011, online, http://allbrandsofthings.com/index.php?main_page=product_info&cPath=33&products_id=457&zenid=adrmed661oj5gqu9dlhqpqgmm7.
Amazon.com—Plastic Trash Can Bag Clip Clamp, review date Feb. 19, 2014, online, http://www.amazon.com/Plastic-Garbage-Rubbish-Trash-Holder/dp/B00E6Q0DQ0/ref=sr.
Petition for Inter Partes Review of U.S. Pat. No. 8,485,565 and Exhibits, filed in the United States Patent and Trademark Office on Mar. 3, 2015, Case No. IPR2015-00838.
Extended European Search Report for European Application No. 25207589.0 mailed Mar. 5, 2026.

* cited by examiner

LOOM WITH ROTATIONALLY INCREMENTABLE PINS

TECHNICAL FIELD

The present disclosure relates generally to a loom for creating articles from a plurality of elastic bands forming a series of Brunnian links. More specifically, this disclosure relates to a loom with a plurality of rotationally incrementable pins.

BACKGROUND

An item formed from elastic bands may be formed by hand or utilizing a device with a set of fixed pins. Elastic bands are biased toward a relaxed position and therefore devices that hold the bands in a stretched condition may be utilized and enable formation of more complex linked articles.

SUMMARY

A Brunnian link is a link formed from a closed loop doubled over itself to capture another closed loop to form a chain. Elastic bands can be utilized to form such links. The example device provides a means of holding elastic bands in place to create an item formed of Brunnian links. The disclosed loom includes openings for pins that enable the pins to be individually installed in a desired rotational orientation.

Although the different examples have the specific components shown in the illustrations, embodiments of this disclosure are not limited to those particular combinations. It is possible to use some of the components or features from one of the examples in combination with features or components from another one of the examples.

These and other features disclosed herein can be best understood from the following specification and drawings, the following of which is a brief description.

DETAILED DESCRIPTION

Figure 1:
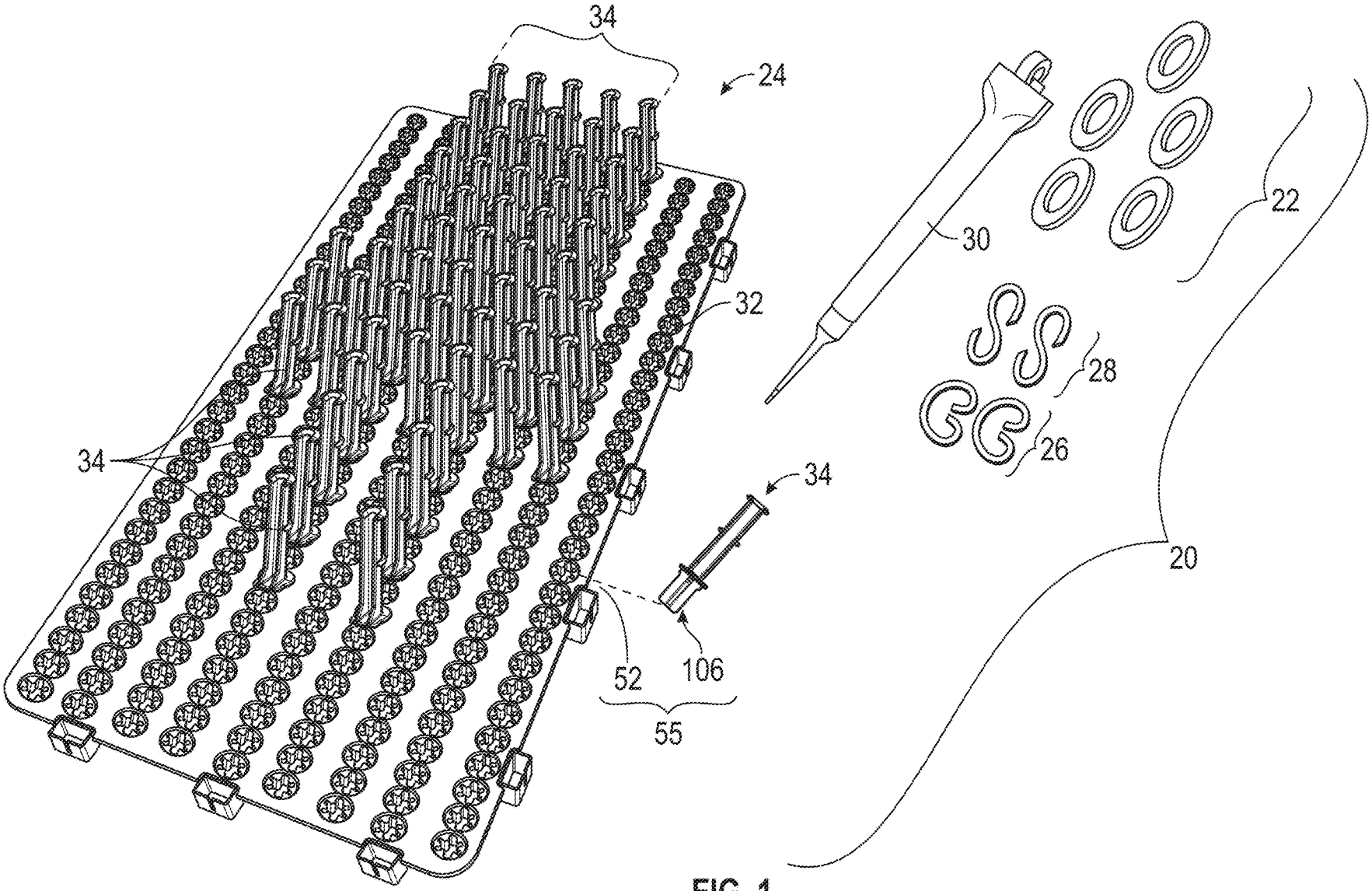
FIG. 1 is a schematic view of an example kit for forming links from elastic bands.

FIG. 1 schematically shows a kit 20 for making a linked item from a plurality of elastic bands 22. The kit 20 includes a loom 24, elastic bands 22 and clips 26, 28. The kit 20 further includes a hook tool 30 for manipulating elastic bands 22 set on the loom 24. A plurality of pins 34 extend from the base 32 when coupled to the base 32. A coupling 55 between the pins 34 and the base 32 includes an opening 52 with an inner peripheral surface 72 (FIG. 12) and a key portion 106. Each of the couplings 55 between the base 32 and pins 34 include mating features that provide for rotationally orientating each of the plurality of pins 34 individually on the base 32. Individual orientation of each of the pins 34 increases the number of different patterns and linking configurations possible for the creation and formation of linked items of varying shapes and sizes.

The example kit may include clips of different shapes. In one example embodiment, the kit may include either, or both a C-shaped clip 26 or an S-shaped clip 28. Either of the C-shaped clip 26 and the S-shaped clip 28 provide for securement of ends of links formed from the elastic bands 22.

Figure 2:
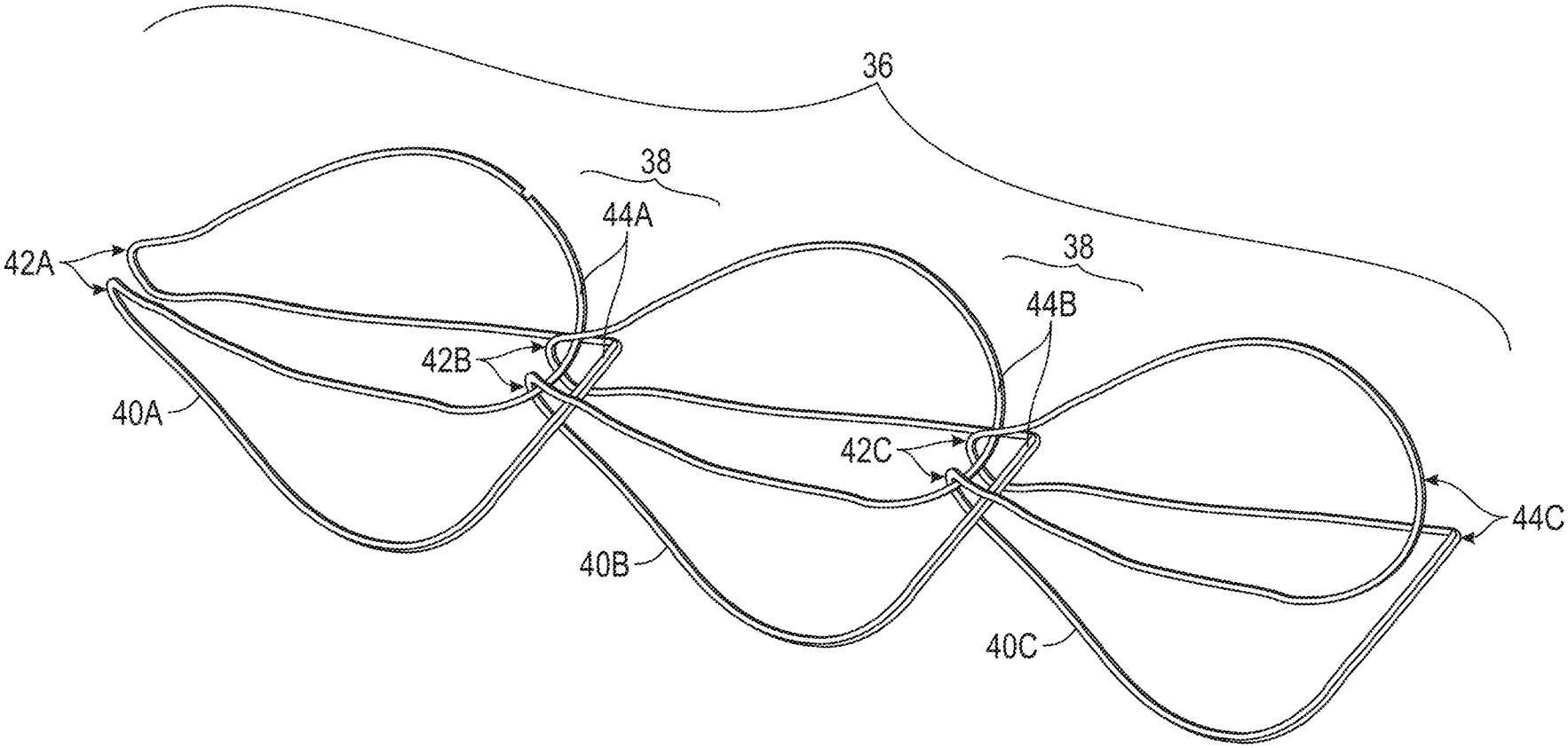
FIG. 2 is a schematic view of a series of Brunnian links.

Referring to FIG. 2 with continued reference to FIG. 1, a Brunnian link is formed from a continuous looped structure, such as the elastic bands 22, without forming an actual knot. FIG. 2 shows several elastic bands 40A-C linked together with a Brunnian link 38 to form a series of links 36. The series of links 36 can be fashioned and combined in many different ways to form many different linked articles. In the example shown, three closed looped elastic bands 40A-C are shown linked together to define a very simple linked item and illustrates how a Brunnian link is formed.

Each link 38 is formed by folding an elastic band 40A-C on to itself to define end portions 42A-C that are captured by a corresponding mid-portion 44A-C of another of the elastic bands 40A-B. The end portions 42A-C are not terminal ends as a closed loop structure does not include ends. Accordingly, the term "end" as it relates to the end portions 42A-C and as used in this disclosure, are the sections of an elastic band that are captured by another elastic band as show in FIG. 2. Each link 38 depends on the previous and subsequent links 38 to maintain the desired linked structure shown. The series of links 36 is shown by way of example and many variations are possible to includes multiple elastic bands captured within each link 38.

The disclosed loom 24 supports the elastic bands in a defined relative orientation to enable many different linking variations based on the simplified Brunnian link shown in FIG. 2.

Figure 3:
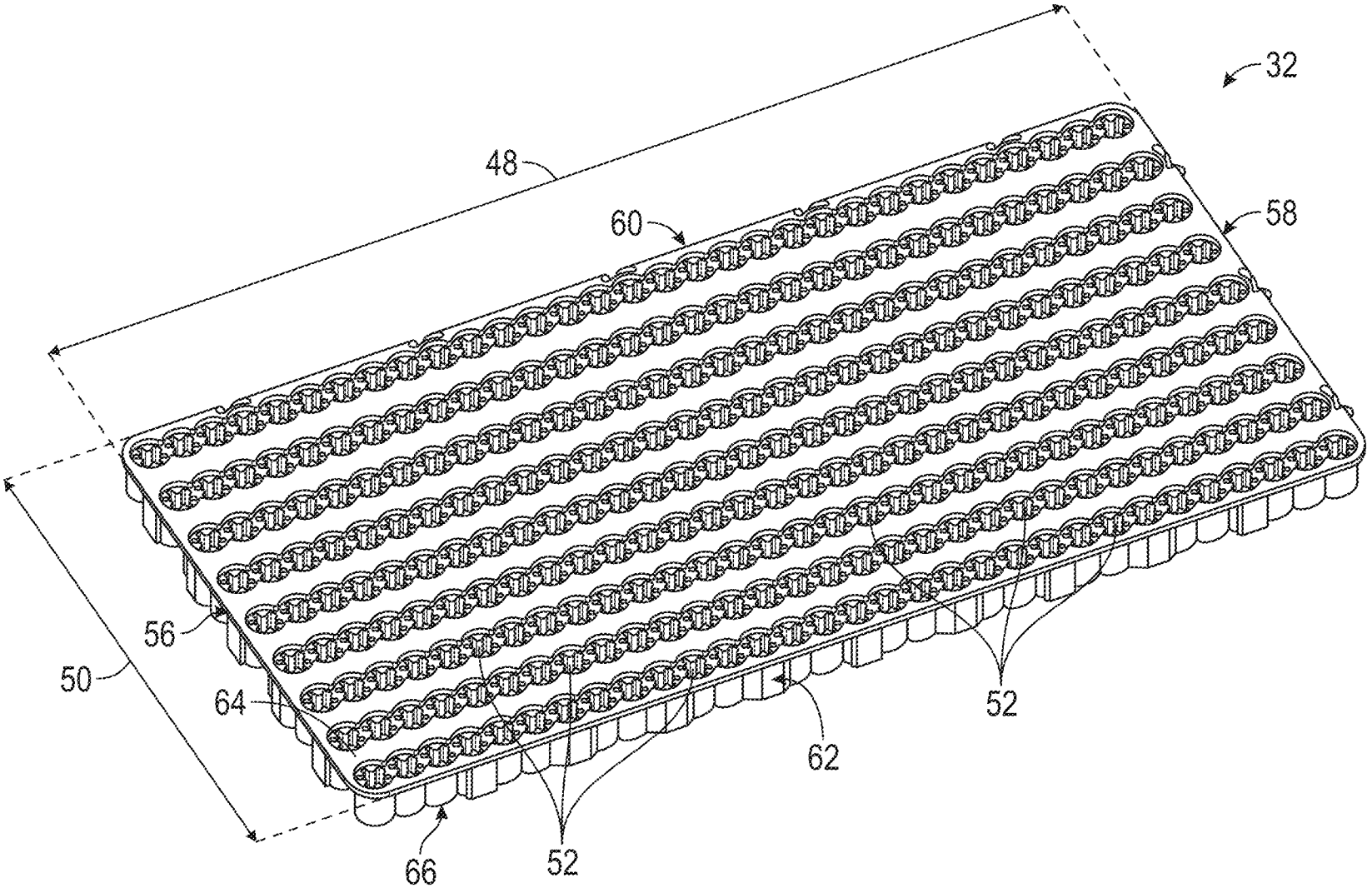
FIG. 3 is a perspective view of a base of a loom.
Figure 4:
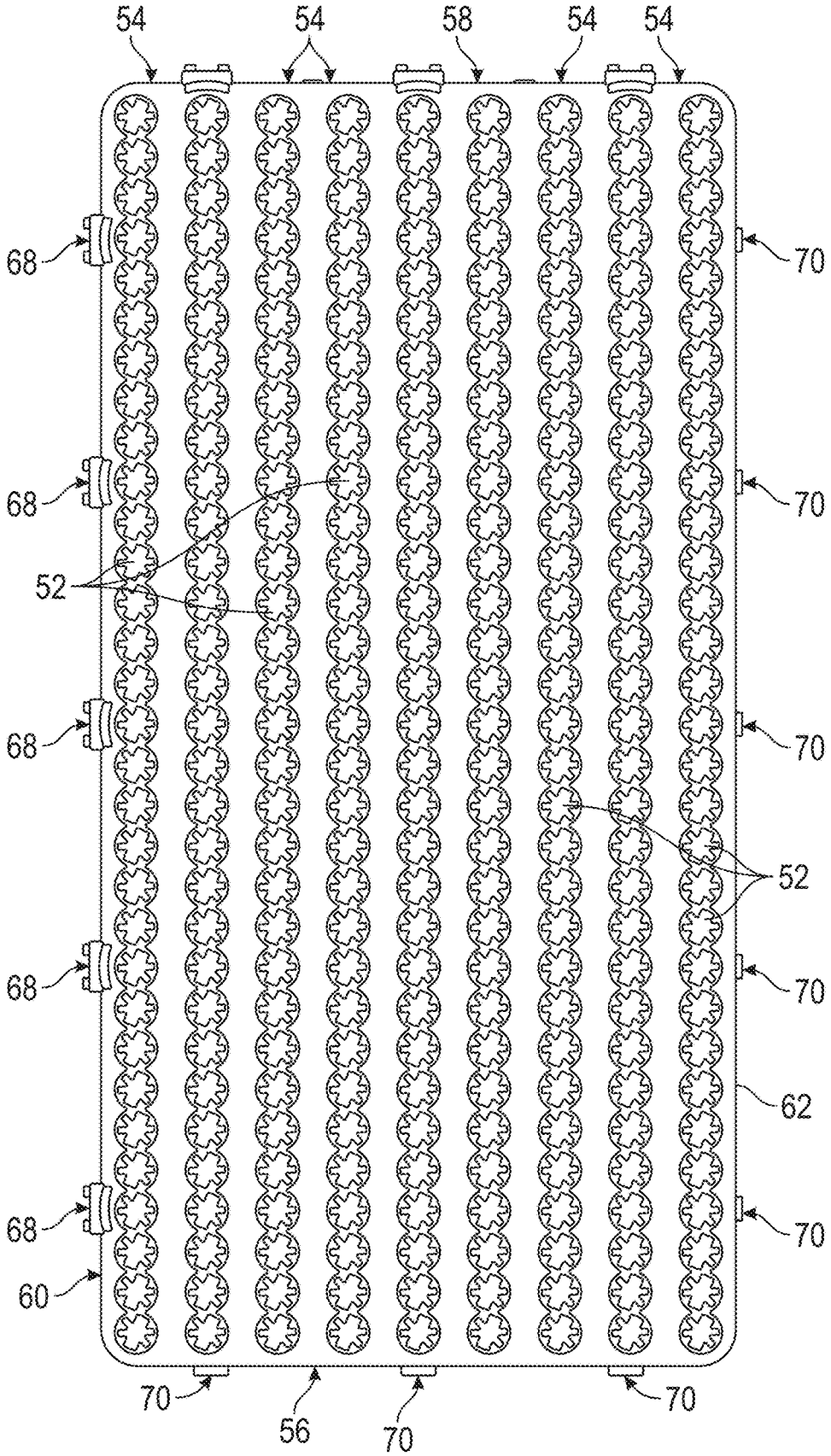
FIG. 4 is a top view of the base of the loom.

Referring to FIGS. 3 and 4, the base 32 of the loom 24 is shown without pins 34 and includes a top surface 64, a bottom surface 66, a front end 56, a rear end 58, a first side 60 and a second side 62. The base 32 includes a longitudinal length 48 and a width 50. The front end 56 and the rear end 58 are separated by the longitudinal length 48. The first side 60 is separated from the second side 62 by the width 50. The top surface 64 is interrupted by a plurality of openings 52. The openings 52 are arranged in columns 54 that extend longitudinally and that are evenly spaced apart in a direction corresponding with the width 50.

Figure 5:
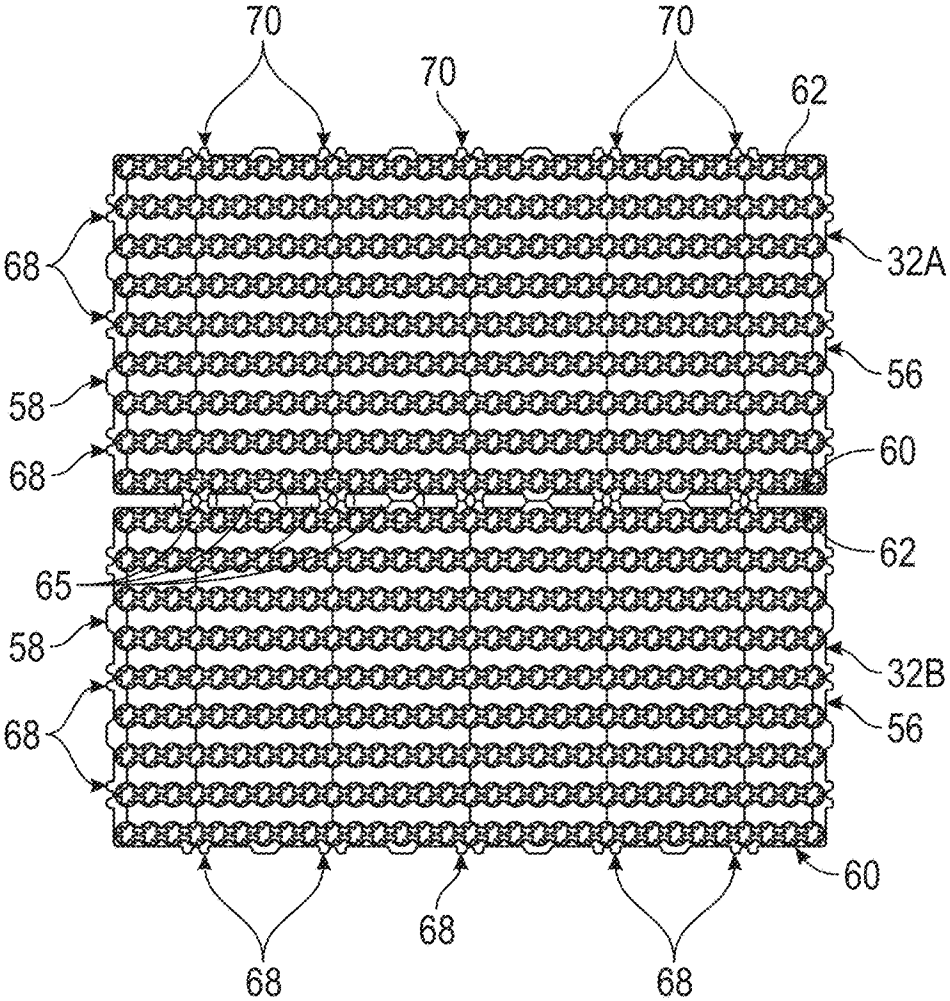
FIG. 5 is a top view of two looms connected together side-by-side.
Figure 7:
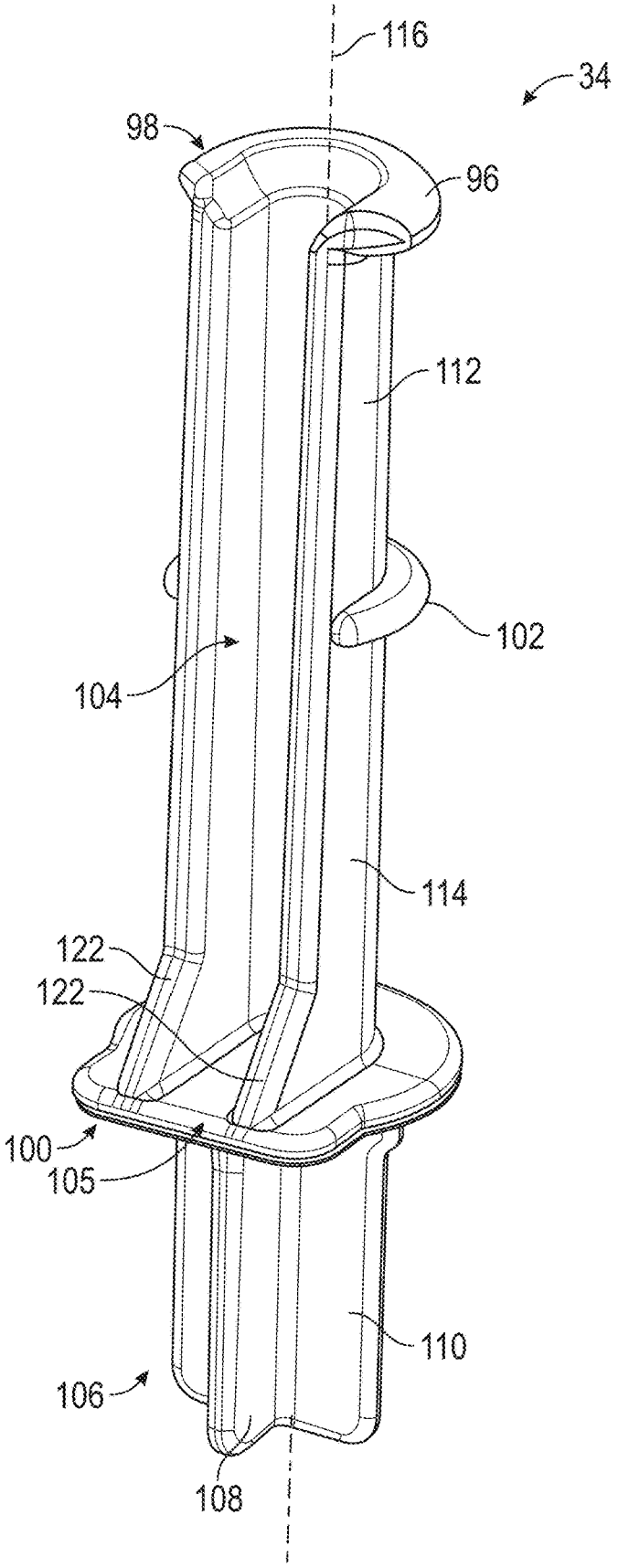
FIG. 7 is a perspective view of an example pin of the loom.

Referring to FIG. 5 with continued reference to FIGS. 3 and 4, the base 32 includes features enabling connection to another base to expand the number openings and thereby the number of possible pin configurations. The base 32 is connectable to another base 32 to double the width or the length. The example shown in FIG. 5 provides for an increased width to double the number of columns 54 available for placing pins 34. Each base 32 includes multiple first connector portions 68 that are configured to receive and connect to a corresponding one of second connector portions 70. The first connector portions 68 are disposed on the first side 60 and the second connector portions 70 are disposed on the second side 62.

Each of the first connector portions 68 defines a pocket and each of the second connector portions 70 defines a tab. The tab is received within the pocket at each connection indicated at 65. Each connection is a light interference fit between the first connector portion 68 and the second connector portion 70 to provide a firm sturdy fit. Although two bases 32A and 32B are shown attached to each other to increase the overall width, additional bases may be similarly connected to further increase the width. Notably, the increase in width provides a doubling of the number of columns 54 of openings 52.

Figure 6:
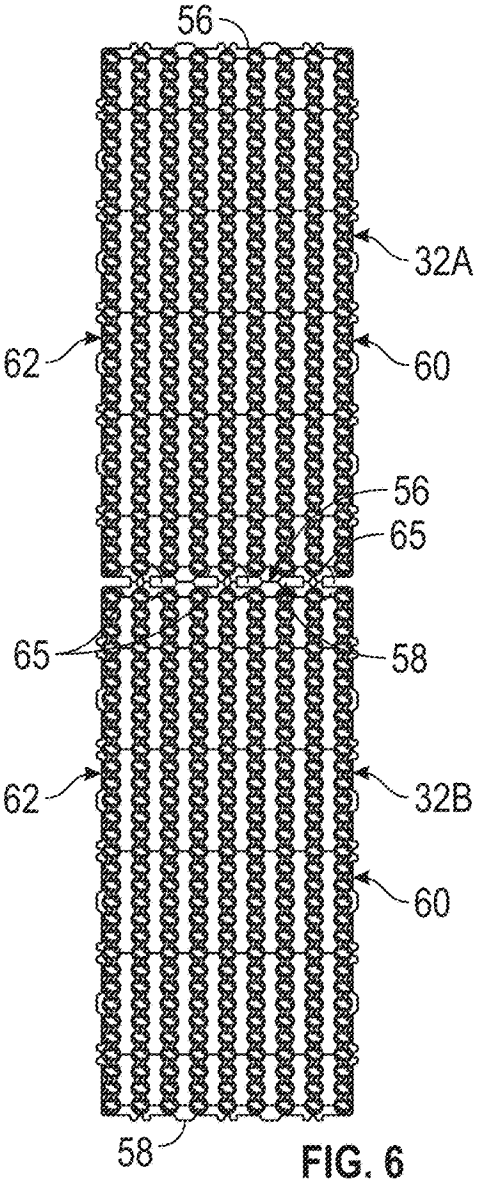
FIG. 6 is a top view of two looms connected together end-to-end.

Referring to FIG. 6, with continued reference to FIGS. 3 and 4, the base 32A is connected to another base 32B lengthwise to double the longitudinal length 48. In the example shown in FIG. 6, each column 54 is doubled in length. First connector portions 68 are provided on each front end 56 of each base 32A and 32B. Second connector portions 70 are provided on each rear end 58 of each base 32A and 32B. The connector portions 68, 70 are engaged to each other as shown at the connections 65 in a light interference fit that firmly holds the bases together without additional structures. In one example embodiment, the first connector portions 68 define a pocket and the second connector portions 70 define a tab that is received within the pocket. The fit between the pocket of the first connector portions 68 and the tap of the second connector portions 70 is a light interference fit.

Although a specific configuration of the connector portions 68, 70 is shown by way of example, other connector structures that provide for the attachment and securement of multiple bases may also be used and are within the contemplation and scope of this disclosure. Moreover, although two bases 32A, 32B are shown attached lengthwise, additional bases may be added to further increase the length of each column.

Referring to FIGS. 7-11 with continued reference to the base 32 as shown in FIGS. 3 and 4, each of the plurality of pins 34 are insertable into openings 52 in a selected direction to rotationally orientate each individual pin to face in a specific unique direction. A plurality of pins 34 are used to create a defined pattern for use in creating a linked article. Each of the pins 34 are generally cylindrical and includes features for supporting and holding elastic bands relative to each other during the formation of links. The configuration of the pin 34 is shown and described by way example and may be of different configurations that provide for holding elastic bands in place during formation of links.

Each of the plurality of pins 34 includes a key end 106 disposed on an end distal from a top end 98. An outwardly extending top flange 96 is disposed at the top end 98. An intermediate flange 102 is disposed between the top flange 96 and the bottom portion 100.

An upper body portion 112 is disposed between the intermediate flange 102 and the top flange 96. A lower body portion 114 is disposed between the intermediate flange 102 and the bottom portion 100. In one example embodiment, the upper body portion 112 and the lower body portion 114 are of a common width 118. The body portions 112, 114 are generally cylindrical, but are interrupted by a slot 104. Accordingly, a cross-section of the body portions 112, 114 is not a complete circumference due to the slot 104.

The top flange 96 includes a width 120 that is larger than the width 118. The larger width 120 of the top flange 96 provides for maintaining elastic bands on the pin 34 when forming links. Accordingly, the top flange 96 extends outwardly relative to the upper and lower body portions 112, 114.

The slot 104 extends from the bottom portion 100 to the top end 98 and extends through the top flange 96. The example slot 104 does not extend through the bottom portion 100. The slot 104 provides a space within the pin 34 into which a hook tool may extend to grasp an elastic band supported on the pin body 112. The slot 104 further provides for an elastic band to be grasped and pulled through the slot 104 and inside of another elastic band supported on the upper body portion 112 during the creation of a link.

In one example embodiment, the bottom portion 100 includes a front side 105 that is a partial squared off shape that extends outward from the generally circular periphery of the bottom portion 100. The slot 104 and the front side 105 are aligned in the example pin 34. A forward rib 122 is disposed on each side of the slot 104 and extends to the front side 105 of the bottom portion 100. The forward ribs 122 provide rigidity to the pin 34 to accommodate forces introduced by elastic bands stretched across pins 34.

Figure 10:
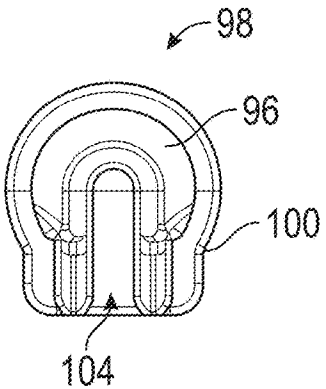
FIG. 10 is a top view of the example pin of the loom.
Figure 11:
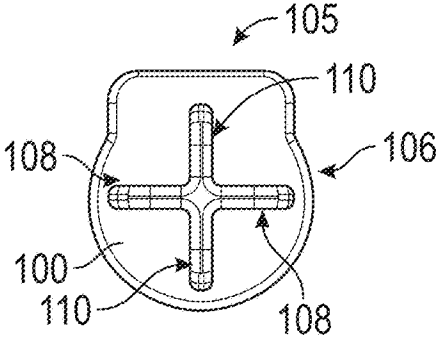
FIG. 11 is a bottom view of the example pin of the loom.
Figure 9:
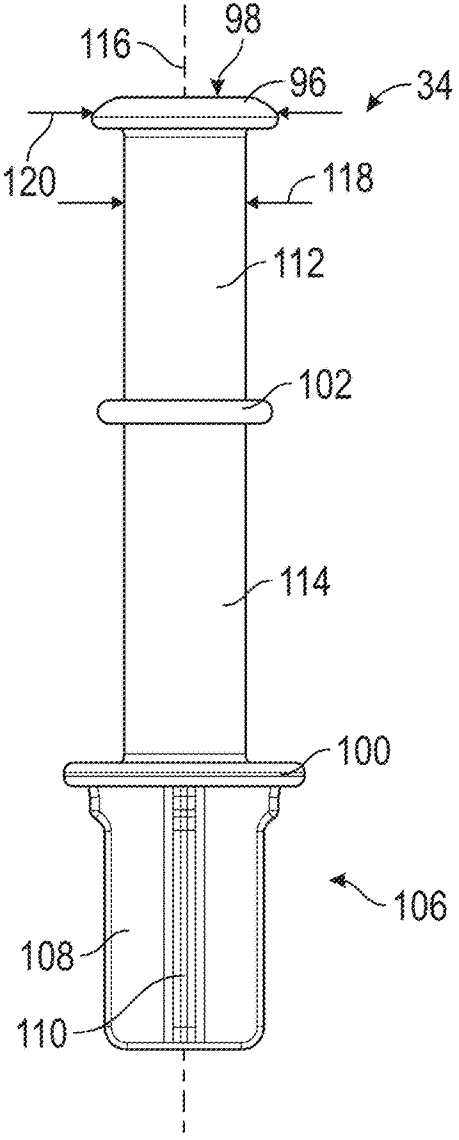
FIG. 9 is a back view of the example pin of the loom.

The pins 34 have a generally U-shaped cross-section when viewed from the top down as shown in FIG. 10. In this disclosure, the front side 105 and the slot 104 provide a forward face of each pin that is used to set patterns for creation of different linked articles. The upper body portion 112 between the top flange 96 and the intermediate flange 102 is where elastic bands are supported prior to being linked together. However, the lower body portion 114 may be utilized in some aspects of link creation within the scope and contemplation of this disclosure.

Each of the pins 34 include the key end 106 that are of a common configuration for all of the plurality of pins 34. The key end 106 provides an interference fit with openings 52 of the base 32 to securely hold the pins 34 in a desired location and orientation. The disclosed key end 106 is generally "X" shaped with a first wall 108 arranged transverse to a second wall 110. The walls 108 and 110 cross each other at the center of the key portion 106. The walls 108, 110 extend away from the bottom portion 100 a distance 123. An intersection of the first wall 108 and the second wall 110 is generally disposed along the pin axis 116.

Figure 8:
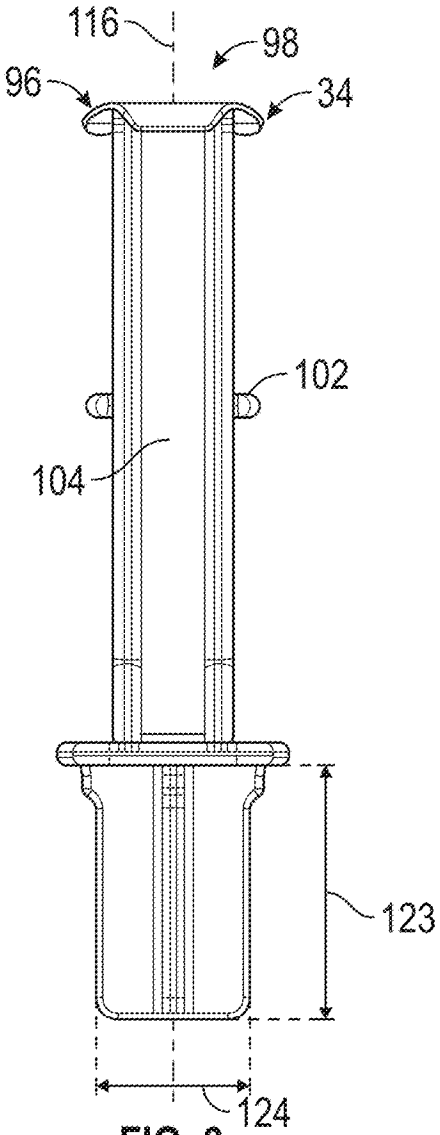
FIG. 8 is a front view of the example pin of the loom.

The first wall 108 and the second wall 110 are symmetric in that both walls 108 and 110 have a common length 123 and width 124 (best shown in FIG. 8). The first wall 108 and the second wall 110 are defined to provides a light interference fit with the openings 52 of the base 32.

Figure 12:
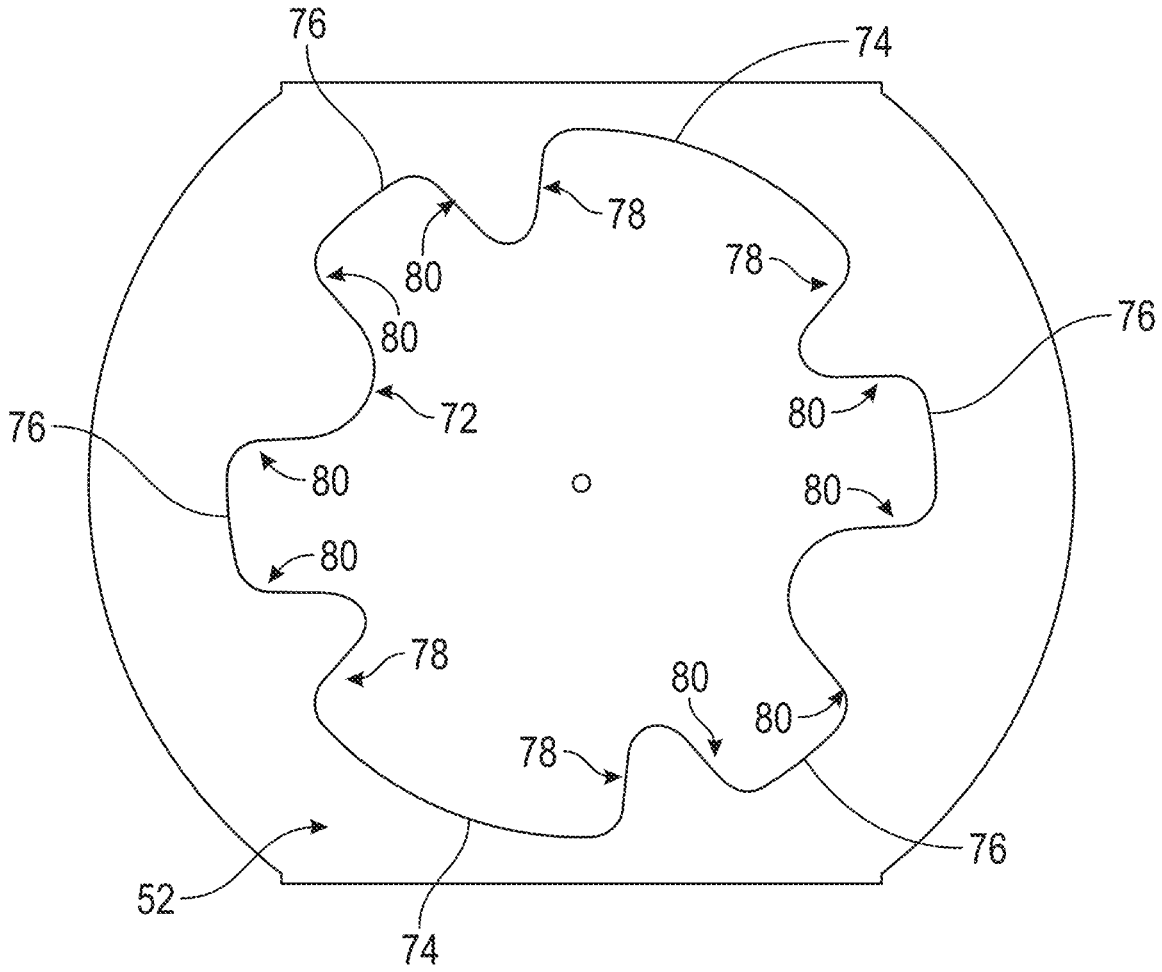
FIG. 12 is a top view of an example opening in the base of the loom.

Referring to FIG. 12, with continued reference to FIGS. 3, 4, 7, 8, 9 and 11, in one example coupling 55 each of the openings 52 in the base 32 includes an inner peripheral surface 72 that defines a profile that receives the key end 106 of one of the pins 34. The inner peripheral surface 72 includes a plurality of notches for rotationally orientating each of the pins 34 about the pin axis 116. In one example embodiment, the notches are not all of a common size or shape. In one example embodiment, the notches include large notches 74 and small notches 76. In the disclosed example, the inner peripheral surface 72 includes two large notches 74 and four small notches 76. The two large notches 74 are arranged across from each other and the four small notches 76 are arranged across from each other.

Each of the large notches 74 include side surfaces 78. Each of the small notches 76 include side surfaces 80. The side surfaces 78, 80 engage corresponding ones of the first wall 108 and the second wall 110 of the key end 106 to secure the pin 34 in place. In the disclosed example, the notch configuration provides for the pin 34 to be rotationally orientated in 45 degree increments.

Figure 13:
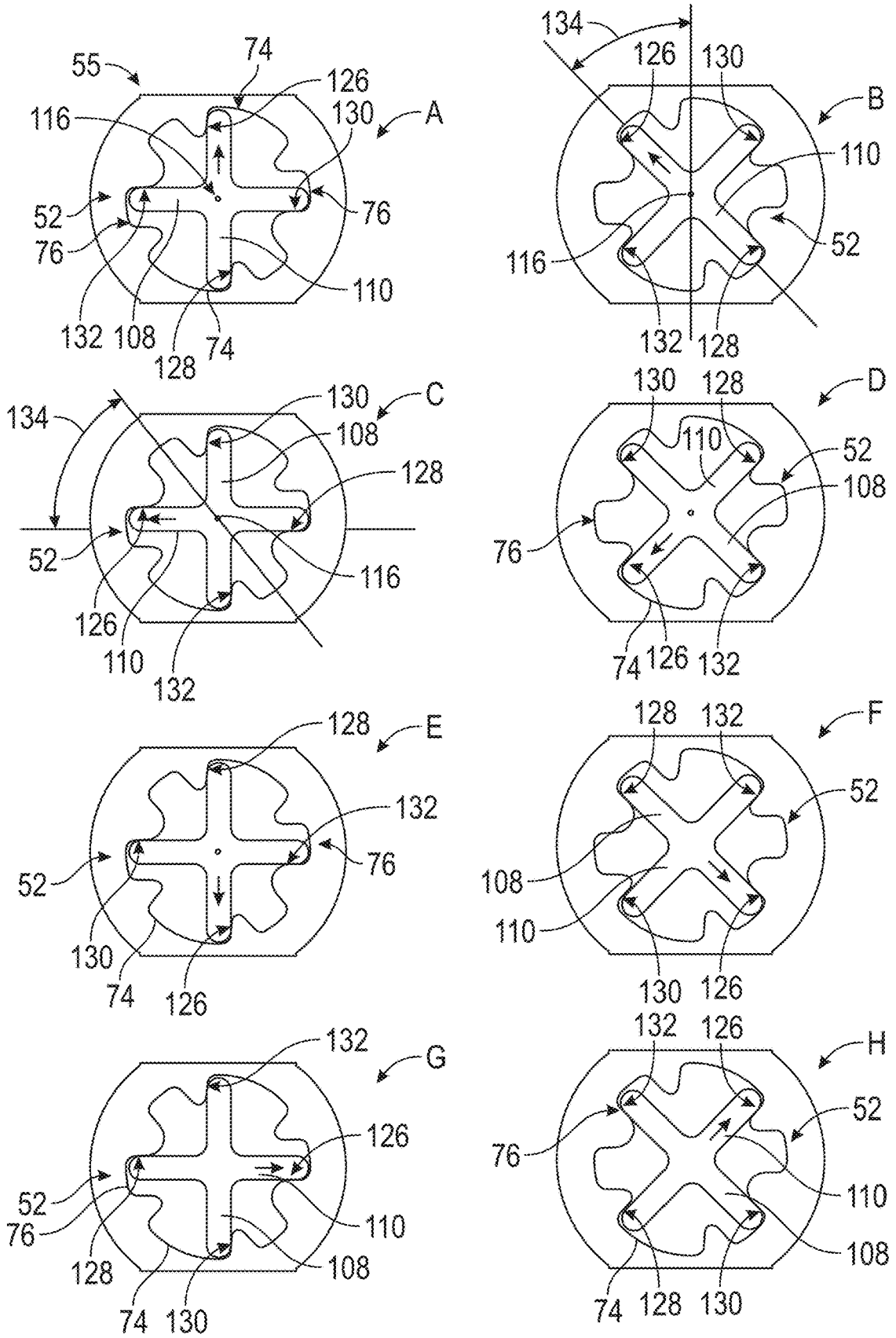
FIG. 13 is a schematic view of a key end of an example pin installed into an opening in the base of the loom at different rotational increments.

Referring to FIG. 13, with continued reference to FIG. 12, an example one of the couplings 55 between the pin 34 and the base 32 is shown in a cross section of the key end 106 within an opening 52 to illustrate the fit. The example fit is between the inner peripheral surface 72 of the opening 52 and the walls 108, 110 of the pin 34. An arrow is shown on an end of the second wall 110 to indicate a forward or front face of the pin 34. FIG. 13 illustrates each rotational increment indicated by the letters A-H of the forward face of the pin 34.

As indicated at increment A, the first wall 108 is engaged at opposing contact points 130 and 132 to side surfaces 80 of opposing small notches 76. The second wall 110 is engaged at opposing contact points 126 and 128 to side surfaces 78 of the opposing large notches 74. Each of the contact points 126, 128, 130 and 132 are an interference fit to prevent the pin 34 from coming free of the opening. The opposing sets of contact points balances forces to hold the pin 34 firmly in place.

The fit indicated at increment B shows the key end 106 rotated one increment 134 as shown by the placement of the wall portion corresponding with the numeral "1". In this example embodiment, the rotational increment 134 is 45 degrees. The contact points 126 and 128 of the second wall 110 move from the large notches 74 to small notches and contact corresponding side surfaces 78. The first wall 108 is fit within the large notches 74 and against opposing side surfaces 80. Accordingly, in this incremented position, each of the first wall 108 and the second wall 110 is held in place by opposing contact points.

The fit indicated at increment C is further incremented by 45 degrees about the pin axis 116. The opposing contact points 126 and 128 switch sides of each wall 108 and 110 of the key end 106. The second end wall 110 moves into different ones of the small notches 76. The first end wall 108 moves to another side of the large notches 74.

The fit indicated at increment D is rotated another 45 degrees. The first wall 108 is moved from the large notches 74 into a small notch 76 and the second wall 110 is moves into a large notch 76. The contact points 126, 128, 130 and 132 are on opposite sides of each of the corresponding walls 108 and 110.

The fit at increment E is rotated 180 degrees from the first increment A. In this position, the first wall 108 is disposed within small notches 76 and the second wall 110 is disposed within the large notch 74. The contact points are reversed but remain on opposing sides of each corresponding wall 108, 110.

The fit at increment F is rotated another 45 degrees with the first wall 108 moving into the large notches 74 and the second wall 110 moving into small notches 76.

The fit at increment G is rotated another 45 degrees such that the forward face of the pin 34 indicated by the arrow has now been incremented 270 degrees from the starting point indicated at increment A. In the incremented position G, the first wall 108 is disposed against side surfaces 80 of the large notches 74 and the second wall 110 is incremented into another small notch 76.

The fit at increment H moves the second wall 110 back into the large notches 74 and the first wall 108 into the small notches 76. The forward face of the pin indicated by the arrow is now incremented 315 degrees from the initial incremented position A. In this position, the second wall 110 is disposed on a side wall 78 of the large notch 74 that is opposite that of the second wall in the increment position A. The first wall 108 is disposed in the small notches 76.

A further incremental rotation of the pin 34 will place the front face indicated by the arrow back at the location shown at increment A.

Accordingly, the example pins 34 may be set at a desired rotational position about the pin axis. In the disclosed example, the pin 34 may set at rotational orientation in 45 degree increments to set the forward face of the pin 34 in a direction that corresponds with a desired linked structure. Although the example opening 52 provides for rotationally setting of each pin in 45 degree increments, other increment graduations could be used, such as for example, 30 degrees, 60 degrees and/or 90 degrees and are within the contemplation and scope of this disclosure.

Figure 14:
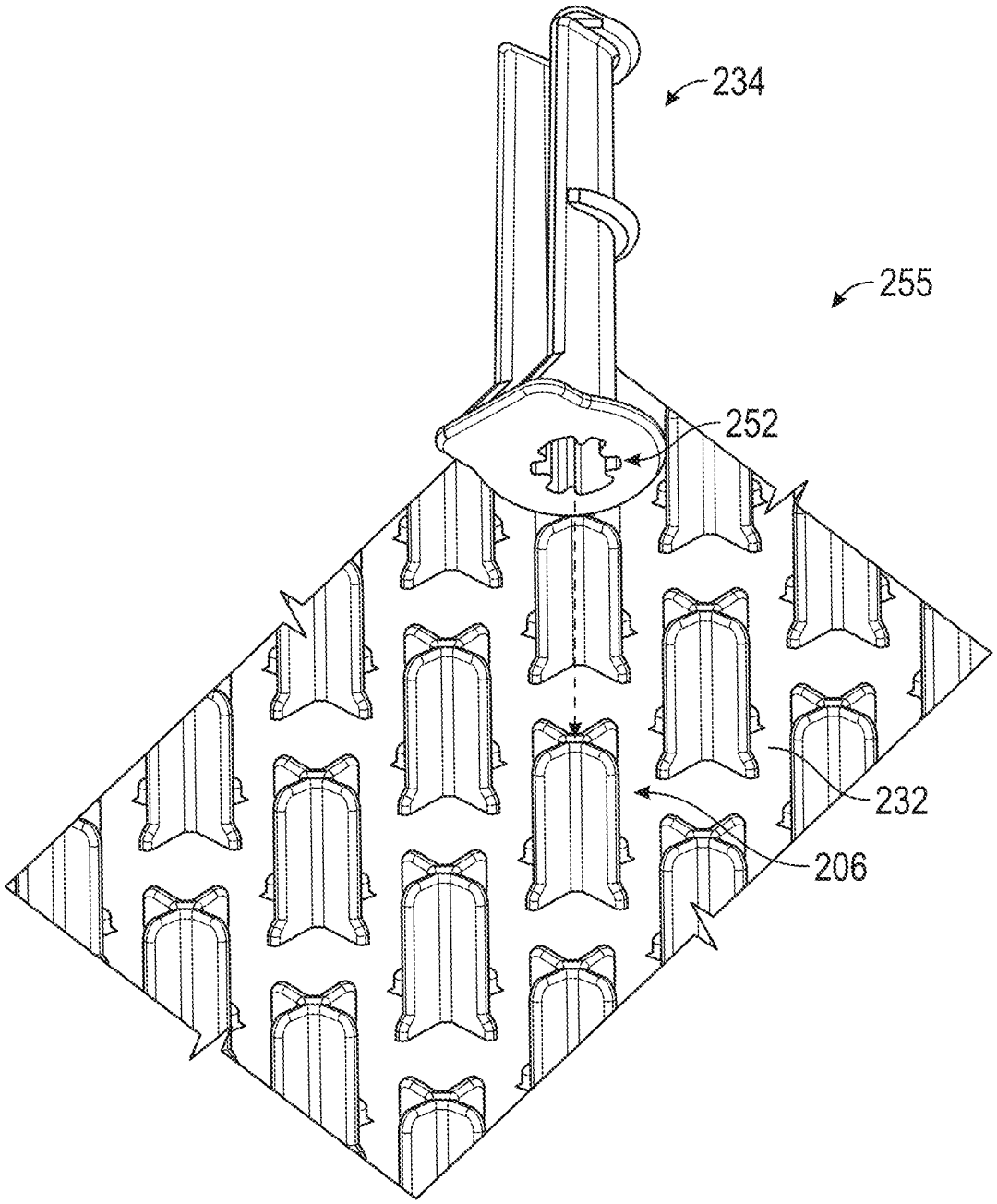
FIG. 14 is a schematic view of example base and pin coupling embodiment.

Referring to FIG. 14, an alternate example coupling 255 is schematically shown and includes a key portion 206 that is part of a base 232 and an opening 252 defined on a pin 234. In the example embodiment shown in FIG. 14, a plurality of key portions 206 extend from the base 232. Each of the example pins 234 includes an opening 252. The example opening 252 includes the features disclosed and explained in reference to FIG. 13 to provide for the circumferential orientation of each pin 234. A plurality of the pins are installable on to corresponding ones of the key portions 206 on the base 232. Although example embodiments of the couplings 55, 255 are explained and shown in this disclosure, other coupling configurations that provides for the circumferential orientation of each pin are within the contemplation and scope of this disclosure.

Figure 15:
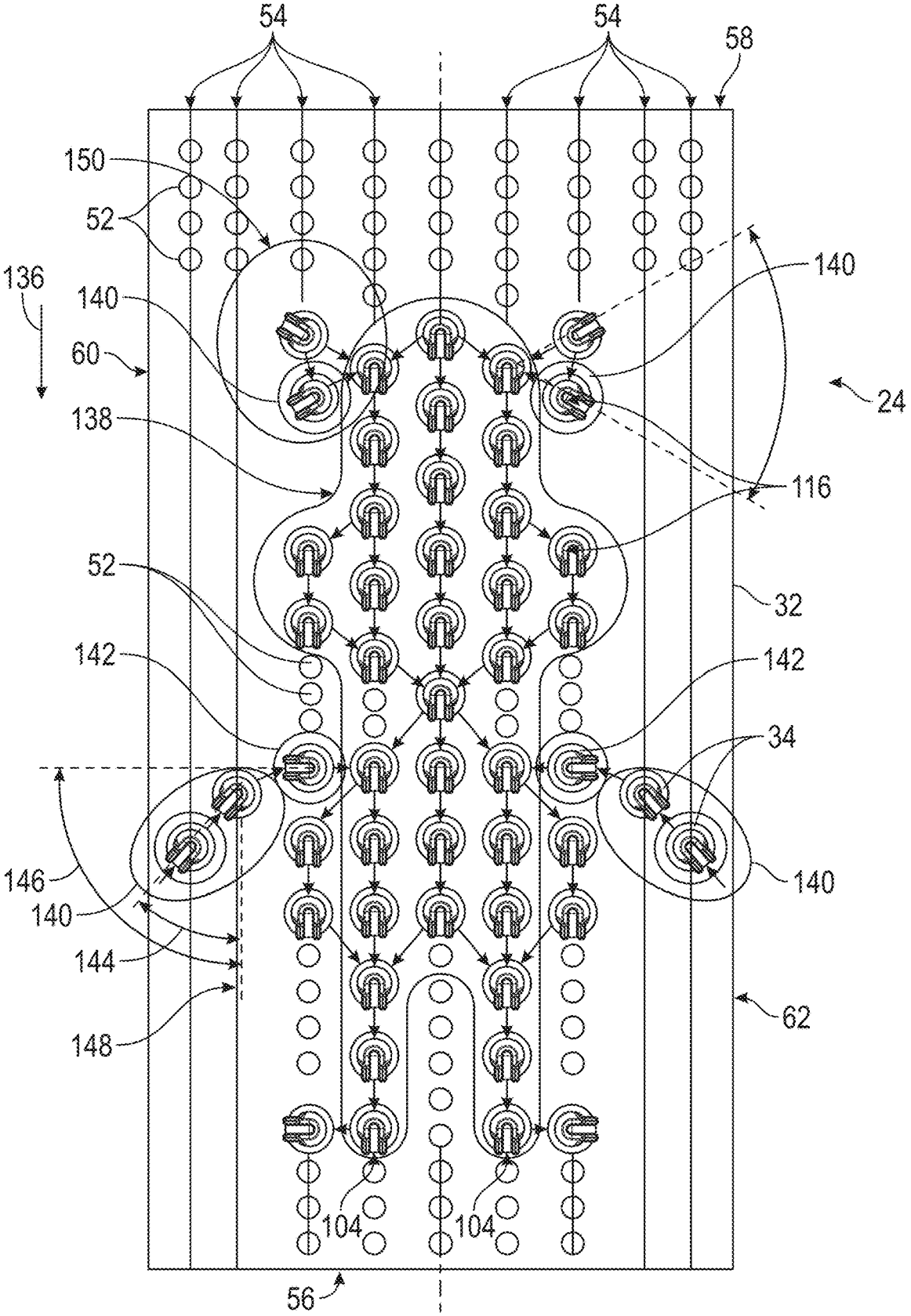
FIG. 15 is a top view of the example loom with pins installed according to a desired pattern.

Referring to FIG. 15, the incremental rotational orientation of the pins 34 provides for the creation different patterns of linked articles. The creation of a linked article includes assembling elastic bands onto the pins 34 in a first direction by stretching elastic bands across adjacent pins. A first elastic band is stretched across two pins, followed by a second band stretched across one of the first two pins to a third pin. This sequence is repeated until the desired number of bands to form the completed linked article are supported on the pins 34 of the loom 24. The bands are then removed, one by one by grasping an end portion of an elastic band and pulling the band through the slot 104 of one pin and setting onto another pin. The moving and setting of the bands is repeated in sequence until the completed article is formed.

The example loom 24 provides for the assembly and removal of elastic bands in different directions as defined by the orientation of each pin 34. As is shown in FIG. 15, a plurality of pins 34 are positioned in openings 52 of the base 32. The majority of the pins 34 are facing in a direction corresponding to the arrow 136 along the longitudinal length 48 (FIG. 3) of the loom 24. Other pins are arranged at an angle relative to the longitudinal length 48. In one embodiment, a first group of pins, as outlined and indicated at 138, is facing toward the front end 56 such that the slot 104 is open toward the front end 56.

A second group of pins 140 are angled relative to the longitudinal length of the base 32 and face in a second direction that is different than the forward facing direction toward the front end 56. A third group of pins is indicated at 142 and face in still another direction that is different than the direction of each of the first group 138 and the second group 140. In one example embodiment, the second group 140 faces in a direction 144 that is 45 degrees from the forward facing first group 138, and the longitudinal length of the base 32. The third group 142 faces in a third direction 146 that is 90 degrees from a line 148 that is parallel to the longitudinal length of the base 32. Accordingly, the pins 34 in the example loom 24 includes at three pins 34 that may all be arranged to face in different directions.

In one operational example embodiment, at least three pins 34 are inserted into openings 52 within the base 32 individually and separately as part of predefined pattern with desired rotational orientation. The rotational orientation of the at least three pins 34 is selected relative to the forward facing direction indicated by arrow 136 and the desired pattern. The forward facing direction 136 is parallel to the longitudinal length of the base 32 and toward the front end 56. At least one of the pins 34 is positioned at an angle different than at least on other of the example pins 34. In one example embodiment, at least one of the pins 34 faces away from another of the plurality of pins 34 as is shown by the pairing of pins indicated at 150.

In the disclosed example shown in FIG. 14, the pins 34 are arranged to form a figure that includes a head, arms, and legs. The figure is formed by arranging the pins 34 in directions relative to each other that define different link segments. Although a specific figure is shown in FIG. 14, other figures, structures, and designs may be formed by selectively and individually placing the pins in a specific location and rotational orientation.

Accordingly, the example kit 20 and loom 24 provides for the formation of many variations of linked structures with individually installable and rotationally orientated pins 34.

Although an example embodiment has been disclosed, a worker of ordinary skill in this art would recognize that certain modifications would come within the scope of this disclosure. For that reason, the following claims should be studied to determine the scope and content of this disclosure.

What is claimed is:

1. A kit for forming an item from closed loop elastic bands, the kit comprising:

a plurality of closed loop elastic bands; and a loom comprising:

a base comprising a front end, a rear end, a first side, and a second side; and a plurality of pins extending from the base when coupled to the base, wherein each of the plurality of pins include a top end, a slot that extends through the top end, wherein a plurality of couplings formed between the base and corresponding ones of the plurality of pins comprises an opening including an inner peripheral surface and a key portion configured for insertion into the opening and to rotationally orientate the pin about a pin axis to arrange the slot to face in a selected direction, wherein the key portion comprises a shape engageable with the inner peripheral surface of the opening for rotationally orientating the pin about the pin axis, the inner peripheral surface comprises a plurality of notches arranged across from each other the plurality of notches includes at least one notch larger than others of the plurality of notches.

2. The kit as recited in claim 1, wherein each of the plurality of pins further comprise an outwardly extending flange and the slot extends through the outward extending flange.

3. The kit as recited in claim 1, wherein the plurality of couplings comprises the base including a plurality of the openings and each of the plurality of pins including the key portion.

4. The kit as recited in claim 1, wherein the plurality of couplings comprises the base including a plurality of the key portions and each of the plurality of pins including the opening.

5. The kit as recited in claim 1, wherein the key portion comprises an X-shape with crossing portions that are engageable with the inner peripheral surface of the opening.

6. The kit as recited in claim 1, wherein the inner peripheral surface is arranged to orientate a corresponding one of the plurality of pins at rotational increments of 45 degrees about the pin axis.

7. The kit as recited in claim 1, wherein the plurality of openings are arranged in evenly spaced apart columns extending from the front end toward the rear end.

8. The kit as recited in claim 7, wherein each of the columns include an equal number of openings.

9. The kit as recited in claim 1, wherein each of the plurality of pins further includes an intermediate flange spaced apart from the top end, wherein the slot extends through the intermediate flange.

10. The kit as recited in claim 1, wherein the front end and rear end including connecting features configured to enable attachment of an additional base.

11. The kit as recited in claim 1, wherein each of the first side and the second side include connecting features configured to enable attachment of an additional base.

12. The kit as recited in claim 1, further comprising a hook tool for manipulating elastic bands arranged across the plurality of pins for forming a link.

13. A loom for forming links utilizing closed loop elastic bands, the loom comprising:

a base comprising a front end, a rear end, a first side, a second side, and a plurality of openings;

a plurality of pins extending from the base when coupled to the base, each of the plurality of pins comprises a top end, an outward extending flange and a slot that extends through the top end and the outwardly extending flange, wherein a plurality of couplings formed between the base and a corresponding one of the plurality of pins comprises a key portion configured for insertion into an opening having an inner peripheral surface for rotationally orientating the pin about a pin axis to arrange the slot to face in a selected direction, wherein the inner peripheral surface includes a plurality of notches arranged to receive the key portion and orientate a corresponding one of the plurality of pins at rotational increments of 45 degrees about the pin axis.

14. The loom as recited in claim 13, wherein the plurality of couplings comprises the base including a plurality of the openings and each of the plurality of pins including the key portion.

15. The loom as recited in claim 13, wherein the plurality of couplings comprises the base including a plurality of the key portions and each of the plurality of pins including the opening.

16. The loom as recited in claim 13, wherein the key portion comprises a shape engageable with the inner peripheral surface of the opening for rotationally orientating the pin about the pin axis.

17. The loom as recited in claim 13, wherein the key portion comprises an X-shape with crossing portions that are engageable with the inner peripheral surface of the opening.

18. The loom as recited in claim 13, wherein each of the plurality of pins further includes an intermediate flange spaced apart from the top flange, wherein the slot extends through the intermediate flange.

19. The loom as recited in claim 13, wherein the plurality of openings are arranged in evenly spaced apart columns extending from the front end toward the rear end and each of the columns include an equal number of openings.

20. The loom as recited in claim 13, wherein each of the front end, the rear end, the first side and the second side including connecting features configured to enable attachment of an additional base.

21. A method of forming a series of linked closed loop elastic bands comprising:

configuring a base to includes a plurality of openings that each includes an inner peripheral surface;

configuring at least three pins to be insertable into at least one of the plurality openings and to include an outward extending flange at a top end, a slot that extends through the top end and the outward extending flange, and a key portion for insertion into a corresponding one of the plurality of openings for rotationally orientating the pin about a pin axis to arrange the slot to face in a selected direction, wherein the key portion comprises a shape engageable with the inner peripheral surface of the opening for rotationally orientating the pin about the pin axis and the inner peripheral surface includes a plurality of notches arranged to receive the key portion and to orientate a corresponding one of the at least three pins at rotational increments of 45 degrees about the pin axis; and inserting the at least three pins into a corresponding number of the plurality of openings in a desired rotational orientation about the pin axis to form a pattern for linking at least two closed loop elastic bands in a Brunnian link.

22. The method as recited in claim 21, further comprising inserting at least one pin in a rotational orientation different than at least one other pin such that the slot of the other pin face in direction different than the at least one pin.

23. The method as recited in claim 22, further comprising inserting additional pins within the plurality of openings at different rotational orientations such that the slots face in different directions relative to a front end of the base.

24. The method as recited in claim 21, further comprising assembling elastic bands to the plurality of pins such that at least one of the elastic bands extend at an angle relative to a longitudinal length of the base.

25. The method as recited in claim 24, wherein at least one of the pins is arranged relative to another of the pins such that a slot of each pin is facing in different directions away from each other.

26. The method as recited in claim 25, further comprising inserting at least one of the plurality of pins such that the slot in a corresponding pin faces in a direction that is at a non-normal angle relative to the longitudinal length of the base.

27. A kit for forming an item from closed loop elastic bands, the kit comprising:

a plurality of closed loop elastic bands; and a loom comprising:

a base comprising a front end, a rear end, a first side, and a second side; and a plurality of pins extending from the base when coupled to the base, wherein each of the plurality of pins include a top end, a slot that extends through the top end, wherein a plurality of couplings formed between the base and corresponding ones of the plurality of pins comprises an opening including an inner peripheral surface and a key portion configured for insertion into the opening and to rotationally orientate the pin about a pin axis to arrange the slot to face in a selected direction, wherein the key portion comprises an X-shape with crossing portions that are engageable with the inner peripheral surface of the opening.

28. The kit as recited in claim 27, wherein each of the plurality of pins further comprise an outwardly extending flange for holding an elastic band in place during formation of a link between at least two elastic bands and the slot extends through the outward extending flange.

29. The kit as recited in claim 27, wherein the plurality of couplings comprises the base including a plurality of the openings and each of the plurality of pins including the key portion.

30. The kit as recited in claim 27, wherein the plurality of couplings comprises the base including a plurality of the key portions and each of the plurality of pins including the opening.

31. The kit as recited in claim 27, wherein the inner peripheral surface is arranged to orientate a corresponding one of the plurality of pins at rotational increments of 45 degrees about the pin axis.

32. The kit as recited in claim 27, wherein each of the plurality of pins further includes an intermediate flange spaced apart from the top end, wherein the slot extends through the intermediate flange.

33. The kit as recited in claim 27, wherein the front end, the rear end, the first side and the second side include connecting features configured to enable attachment of an additional base.

* * * * *